US005437514A

United States Patent [19]

Minch

[11] Patent Number: 5,437,514

[45] Date of Patent: Aug. 1, 1995

[54] PHOTOGRAPHIC ALBUM LEAF

[75] Inventor: Paul A. Minch, Lakewood, Ohio

[73] Assignee: The Chilcote Company, Cleveland, Ohio

[21] Appl. No.: 342,424

[22] Filed: Nov. 18, 1994

[51] Int. Cl.[6] ..... B42F 13/00

[52] U.S. Cl. ..... 402/79; 281/38; 40/156; 40/159

[58] Field of Search ..... 281/15.1, 31, 38; 402/79, 80 R; 40/152, 154, 156, 158.1, 159

[56] References Cited

U.S. PATENT DOCUMENTS

| | | | |
|---|---|---|---|
| 386,874 | 7/1988 | Foltz | 40/159 |
| 522,484 | 7/1994 | Odgers | 40/159 |
| 525,458 | 9/1994 | Hanawalt | 40/159 |
| 1,955,049 | 4/1934 | Bodie | 40/537 |
| 2,169,290 | 8/1939 | Rossi | 40/159 |
| 2,521,792 | 9/1950 | Hollander | 40/537 |
| 3,797,152 | 3/1974 | Brandt | 402/79 |
| 3,826,026 | 7/1974 | Bevan | 40/591 |
| 4,145,830 | 3/1979 | Desmarais et al. | 40/404 |
| 4,172,332 | 10/1979 | Holes et al. | 40/537 |
| 4,217,711 | 8/1980 | Spresser et al. | 40/649 X |
| 4,424,637 | 1/1984 | Leahy | 40/152 |
| 4,825,573 | 5/1989 | Roberts et al. | 40/642 |
| 5,290,118 | 3/1994 | Ozeki | 402/79 |
| 5,316,404 | 5/1994 | Hensel | 402/79 |

*Primary Examiner*—Willmon Fridie
*Attorney, Agent, or Firm*—Rankin, Hill, Lewis & Clark

[57] ABSTRACT

A leaf for a photographic album has a backing layer upon which a photograph may be mounted. On the backing layer is a frame layer has a central opening within which the photograph may be mounted on the backing layer. The frame layer is embossed adjacent to the central opening to form an embossed portion. The frame layer is attached to the backing layer along three of its four sides leaving a fourth side which is not attached to the backing layer, forming an access passageway. The embossed portion is spaced from the backing layer to form a slot therebetween. A mat layer is adapted to be inserted through the access passageway. The mat layer has an aperture through which a photograph mounted on the backing layer may be viewed. The outer edges of the mat layer are held within the slots formed by the embossed portions. The mat layer is locked in position by engagement with the embossed portions on all four sides of the frame layer. The leaf can be used with different mat layers providing a variety of differently sized and shaped apertures. The embossed portion eliminates the need for an additional spacing member to position the mat layer.

6 Claims, 3 Drawing Sheets

PHOTOGRAPHIC ALBUM LEAF

BACKGROUND OF THE INVENTION

1. Field of the Invention

This invention relates to pages or leafs of albums for displaying photographs, and more particularly to album leafs having a mat surrounding the photograph.

2. Description of the Prior Art

Photographic albums are used by professional photographers and others for the storage and display of photographs. One typical use for such albums is in the preparation of wedding albums which are prepared by professional photographers to present and display wedding photographs.

Some of these albums use mats to frame and display the photographs, and it is desirable to have the capability of using various sizes and shapes of mats depending upon the photograph being displayed. However, it would be expensive to supply a variety of album leafs each having a differently shaped mat, and the attachment of a selected mat to the album leaf by the user by gluing the mat in place would be difficult and messy.

One solution to these problems is found in U.S. Pat. No. 4,825,573, issued to Roberts et al. The Roberts et al. patent provided for insertion of a mat within a pocket formed by rim member and a card member. The card member was configured such that it locked the mat in place between the rim member and the cover member. However, the Roberts et al. construction required the presence of the card member which had to be properly positioned and secured between the base and the rim, and required that the card member be exactly cut and positioned to fit the mat so that the mat was properly locked in place.

SUMMARY OF THE INVENTION

The disadvantages of the prior art album leafs are overcome by the present invention which provides for the insertion of a mat layer which has one or more of a variety of variously shaped openings. In accordance with the present invention, the mat layers are locked in place without the necessity of a separate card member or spacer member in the album leaf which would otherwise add to the cost and complexity of the construction. Thus, the album leaf of the present invention avoids the use of a separate locking member, so that a frame layer may be provided which holds the mat layer precisely in place and so that the frame layer is directly adhered to the backing layer without an intermediate member which would make the design of the album leaf more complex and would make the album leaf more expensive to produce.

The album leaf of the present invention avoids the use of an intermediate spacing member by embossing a portion of the frame layer around the central opening to form an inner peripheral embossed portion which is spaced away from the backing layer providing a slot within which the outer edges of the mat layer are captured. The album leaf of the present invention thus provides a finished professional appearance, while eliminating an element of the prior art album leafs to achieve an album leaf with a simplified construction which uses replaceable mat layers.

These and other advantages are achieved by the present invention of a photographic album leaf which comprises a backing layer upon which a photograph may be mounted. There is a frame layer on the backing layer.

The frame layer has a central opening within which the photograph may be mounted on the backing layer. The frame layer has four side segments. Each side segment of the frame layer has a base portion, a raised portion and a transitional portion. The base portion is located around the outer portion of the frame layer and is attached to the backing layer along three of the four side segments leaving a fourth side segment in which the frame layer is not attached to the backing layer. An access passageway is formed between the backing layer and the fourth side segment of the frame layer. The raised portion is located around the inner periphery of the frame layer adjacent to the central opening. The raised portion is spaced from the backing layer to form a slot therebetween. The transitional portion connects the base portion and the raised portion. A mat layer is adapted to be inserted through the access passageway. The mat layer has an aperture through which the photograph mounted on the backing layer may be viewed. The outer edges of the mat layer are held within the slots formed by the raised portions. The mat layer is locked in position by engagement with the transition portions on all four side segments of the frame layer.

DETAILED DESCRIPTION OF THE PREFERRED EMBODIMENT

Figure 1:
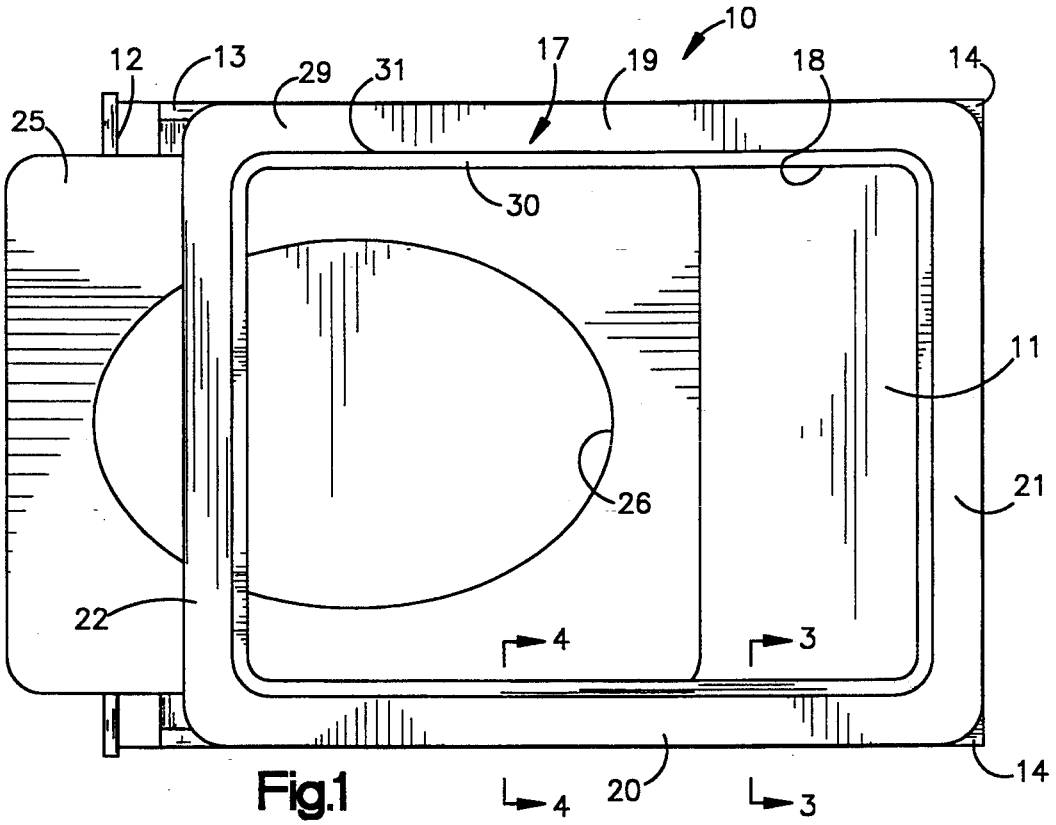
FIG. 1 is an elevational view of the photographic album leaf of the present invention showing the mat layer being inserted.

Referring more particularly to the drawings, there is shown the album leaf 10 of the present invention. The leaf 10 comprises a generally rectangular base or backing layer 11 made of a relatively stiff cardboard. At least a portion of the backing layer may be covered with a wettable adhesive so that photographs may be adhered to each side of the backing layer. The inside edge of the backing layer 11 is attached to a suitable hinge assembly 12. Various hinge assemblies are well known in compiling leafs into albums, and any suitable hinge assembly may be used. Extending around the outer periphery of the other sides of the backing layer 11 is a decorative edging layer 13, which is preferably gold in color. Corner covers 14 may be used to protect the corners, and these corner covers may also be gold in color to match the edging layer 13.

Two frame layers 17 extend around the outer periphery on each side of the backing layer 11. The frame layers 17 are each made of a suitable material which is preferably has a resemblance to leather, as is well known in the art. Since both frame layers 17 are identical, both will be described with respect to the frame layer on one side of the backing layer 11. As shown more particularly in FIGS. 1 and 2, each frame layer 17 is generally rectangular in shape and has approximately the same outer dimensions as the backing layer 11 so that the frame layer is generally coextensive with the backing layer. The frame layer 17 has a large rectangular central opening 18, so that the frame layer comprises four segments, viz., a top segment 19 extending along the top side, a bottom segment 20 extending along the bottom side, an outer side segment 21 extending along the outer side, and an inner side segment 22 extending along the inner side near the hinge assembly 12.

The top segment 19, the outer side segment 21 and the bottom segment 20 of the frame layer 17 are all secured or adhered to the backing layer 11 by a suitable adhesive to attach the frame layer to the backing layer. The inner side segment 22 of the frame layer 17 is not adhered to the backing layer 11, so that an access passageway is formed between the backing layer 11 and the inner side segment 22 of the frame layer. This passageway provides for the insertion of a mat layer 25 between the frame layer 17 and the backing layer 11 as shown in FIG. 1.

Figure 2:
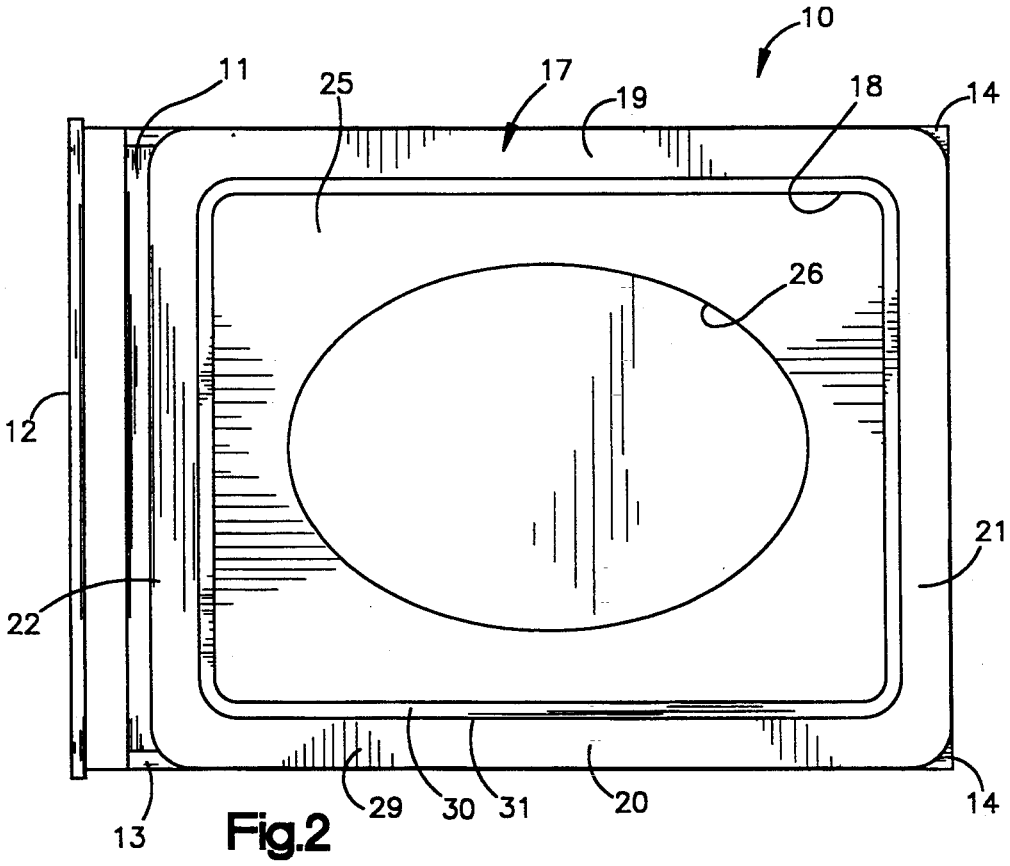
FIG. 2 is an elevational view similar to FIG. 1 with the mat layer inserted.
Figure 5:
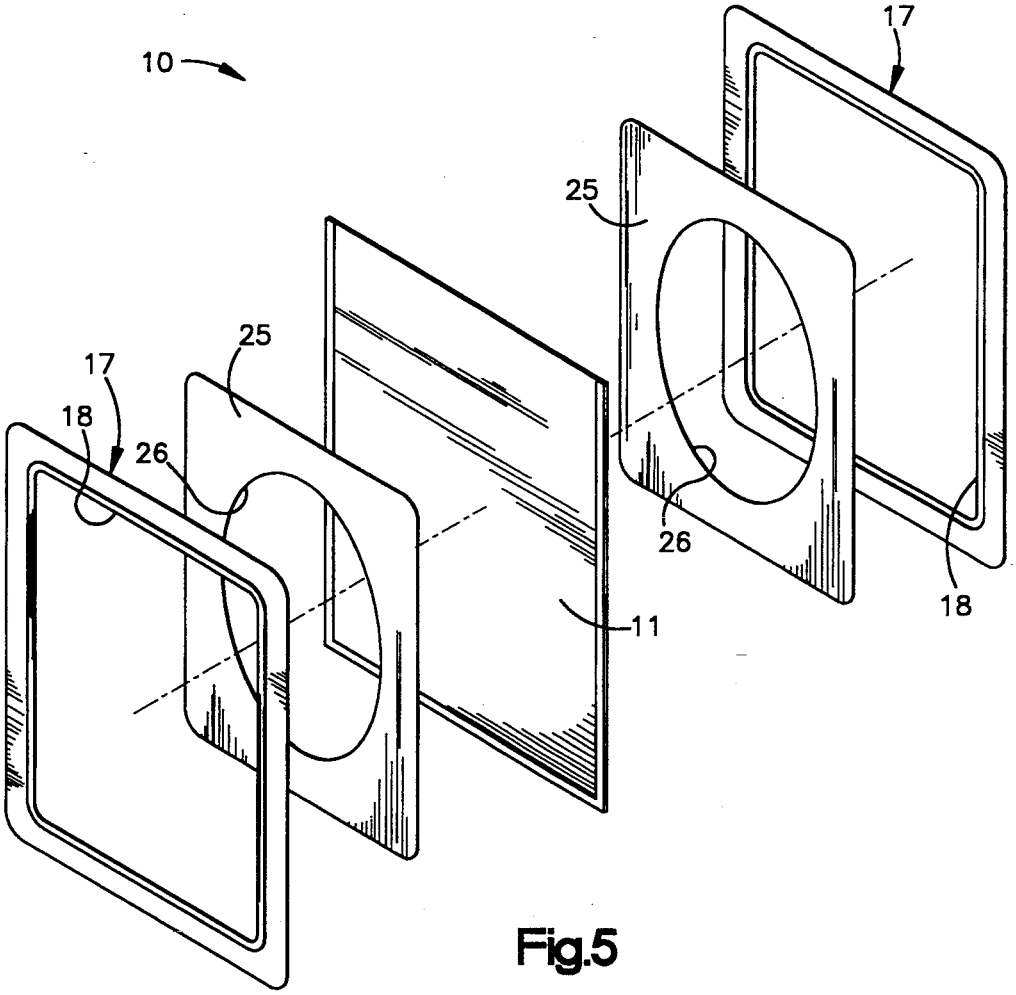
FIG. 5 is an exploded perspective view showing the separate layers of the leaf.

The mat layer 25 provides a means for covering the opening 18 in the frame layer 17 and provides a matting for attractive display of photographs mounted on the backing layer 11. The mat layer 25 is preferably made of material similar to that from which the frame layer 17 is made, and it may be made in the same color as the frame layer or in a complementary color. The mat layer 25 is mounted on top of the photograph and has an aperture or opening 26 through which the photograph is displayed. The opening 26 shown in FIGS. 1, 2 and 5 is oval in shape. However, the opening 26 may be any shape which favorably displays the photograph or photographs mounted on the backing layer 11, and it is contemplated that a collection of mat layers having variously sized and shaped openings will be available to the user, so that the user may select the mat layer with the appropriately shaped opening which will complement the photograph being displayed. Although only one opening 26 is shown in FIGS. 1 and 2, multiple openings can be used if, for example, multiple photographs are mounted on the backing layer 11. A gold trim may be printed on the mat layer 25 around the opening 26.

Figure 3:
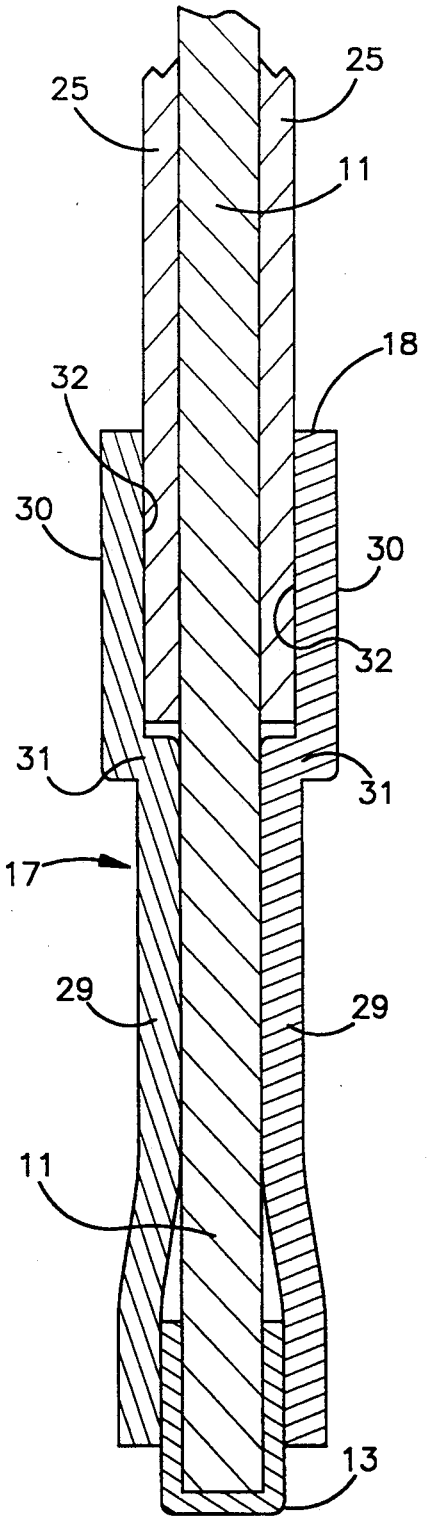
FIG. 3 is a sectional view taken along line 3—3 of FIG. 1.
Figure 4:
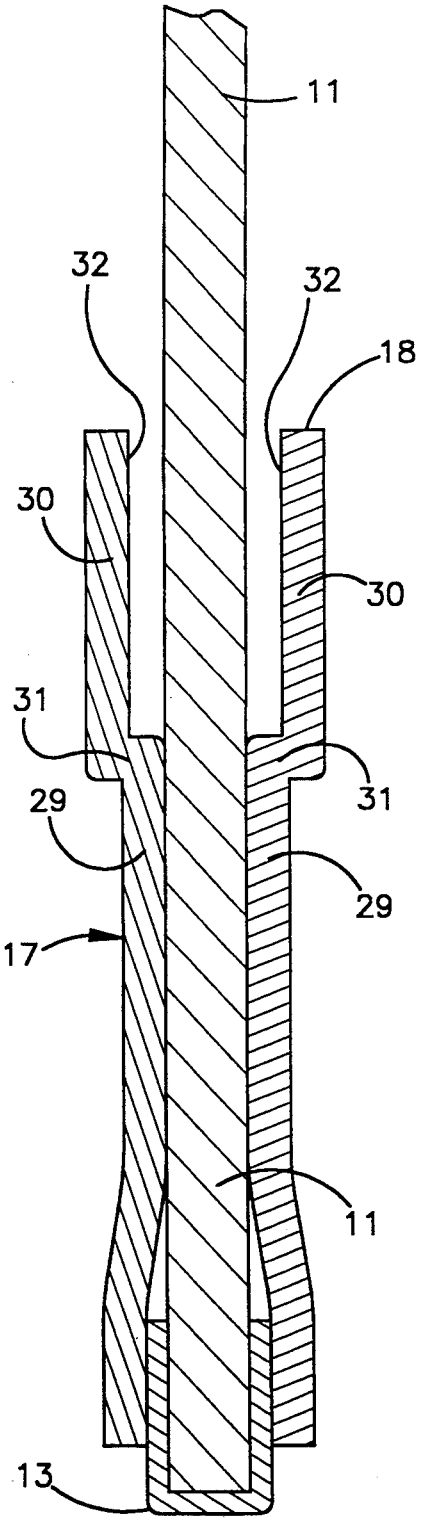
FIG. 4 is another sectional view taken along line 4—4 of FIG. 1.

As shown in FIG. 4, the portion of the frame layer 17 adjacent to the opening 18 is embossed such that each segment of the frame layer comprises an outer base portion 29, an inner raised portion 30, and a transition portion 31 between the base portion 29 and the raised portion 30. The outer base portion 29 of the frame layer 17 is parallel to the backing layer 11 and is, in part, adhered to the backing layer by suitable adhesive to secure the frame layer to the backing layer. The raised portion 30 is located along the inner edge of the frame layer 17 adjacent to the opening 18, and is spaced from the backing layer 11 to form a recess or slot 32. The slot 32 is adapted to retain the outer peripheral edge of the mat layer 25 as shown in FIG. 3. The transition portion 31 of the frame layer 17 connects the outer base portion 29 with the inner raised portion 30 and extends in a direction away from the plane of the backing layer 11 and the plane of the base portion 29. The transition portion 31 is preferably formed by embossing the frame layer 17 using any known suitable embossing process. The dimensions of the embossed transition portion 31 of the frame layer 17 should match the outer dimensions of the mat layer 25 as closely as possible, so that the mat layer is locked in place by engagement with the transition portions 31 of the frame layer 17 when the outer peripheral edges of the mat layer are positioned within the slots 32.

In use, the leaf 10 of the present invention is provided to the user as part of an album. The user adheres one or more photographs to each side of the backing layer 11 on each leaf 10 in the album. As previously mentioned, the backing layer 11 may be provided with a moistenable adhesive to assist in mounted the photographs to the backing layer; the user may alternatively employ double-sided tape or other means to secure the photographs to the backing layer.

After each photograph has been mounted, the user then selects and inserts the desired mat layer 25. As previously discussed, a collection of mat layers 25 is preferably available to the user, and the user selects the desired mat layer from this collection. Such a collection would include the mat layers having oval openings 26 as shown in FIGS. 1, 2 and 5, as well as other mat layers having rectangular openings of various sizes, and may include mat layers having multiple openings. The user selects the desired mat layer 25 and inserts the selected mat layer through the access passageway between the inner side segment 22 of the frame layer 17 and the backing layer 11 as shown in FIG. 1.

As the mat layer 25 is being inserted, the top and bottom edges of the mat layer 25 engage the raised portions 30 on the top and bottom segments 19 and 20 of the frame layer 17 to guide the mat layer 25 in place. The transition portions 31 on the top and bottom segments 19 and 20 of the frame layer 17 act as tracks to assist in guiding the mat layer 25 into place.

When the mat layer 25 has been fully inserted, the forward edge of the mat layer 25 (on the right in FIG. 1) engages the transition portion 31 on the outer side segment 21 of the frame layer 17, resisting further insertion of the mat layer 25. As the forward edge of the mat layer 25 engages the transition portion 31 on the outer side segment 21, the opposite edge of the mat layer 25 clears the base portion 29 on the inner side segment 22 of the frame layer 17, and the transition portion 31 of the inner side segment 22 of the frame layer engages the opposite edge of the mat layer 25. The mat layer 25 is thereby locked in the exact desired position with respect to the frame layer 17 by the transition portions 31 and the raised portions 30 on the frame layer 17 surrounding it.

By embossing the inner portions of the frame layer 17 adjacent to the opening 18, it is unnecessary to provide a separate locking member or spacing member, as was the case with the prior art. Thus the present invention provides for desirable placement of the mat layer 25 locked in place to precisely position the mat layer relative to the rest of the album leaf 10, while permitting the base portion 29 of the frame layer 17 to be directly secured to the backing layer 11 (along three of the four segments of the frame layer) without the necessity of an intermediate card member or locking member.

Although the present invention has been described with respect to a photographic album leaf, it contemplated that the concept of the invention can be employed in other devices for the display of photographs such as photographic cases and frames. In each case, the backing layer would be supplied with the frame layer and mat layer of the present invention, and the ability to use mat layers using variously shaped openings would be achieved.

Other variations and modifications of the specific embodiments herein shown and described will be apparent to those skilled in the art, all within the intended spirit and scope of the invention. While the invention has been shown and described with respect to particular embodiments thereof, these are for the purpose of illustration rather than limitation. Accordingly, the patent is not to be limited in scope and effect to the specific embodiments herein shown and described nor in any other way that is is inconsistent with the extent to which the progress in the art has been advanced by the invention.

What is claimed is:

1. A photographic album leaf, which comprises:

a backing layer upon which a photograph may be mounted;

a frame layer on the backing layer, the frame layer having a central opening within which the photograph may be mounted on the backing layer, the frame layer having four side segments, each side segment of the frame layer having a base portion, a raised portion and a transitional portion, the base portion being located around the outer portion of the frame layer and being attached to the backing layer along three of the four side segments leaving a fourth side segment in which the frame layer is not attached to the backing layer, an access passageway being formed between the backing layer and the fourth side segment of the frame layer, the raised portion being located around the inner periphery of the frame layer adjacent to the central opening, the raised portion being spaced from the backing layer to form a slot therebetween, the transitional portion connecting the base portion and the raised portion;

a mat layer adapted to be inserted through the access passageway, the mat layer having an aperture through which a photograph mounted on the backing layer may be viewed, the outer edges of the mat layer being held within the slots formed by the raised portions, the mat layer being locked in position by engagement with the transition portions on all four side segments of the frame layer.

2. A photographic album leaf as defined in claim 1, wherein the outer edges of the frame layer on three sides are coextensive with the outer edges of the backing layer.

3. A photographic album leaf as defined in claim 1, wherein the distance between opposite transition portions of the frame layer approximately matches the width of the mat layer.

4. A photographic album leaf as defined in claim 1, wherein the transition portion extends in a direction away from the plane of the backing layer.

5. A photographic album leaf as defined in claim 1, comprising in addition a hinge assembly attached to the backing layer along a side of the backing layer adjacent to the access passageway.

6. A photographic album leaf, which comprises:

a backing layer;

a generally rectangular frame layer mounted on one side of the backing layer around the outer periphery of the backing layer, the frame layer having an enlarged generally rectangular central opening forming a generally rectangular frame having four segments, the frame layer having an embossed portion surrounding the central opening, the embossed portion providing an outer portion which is parallel to the backing layer, an inner portion which is spaced from the backing layer to form a recess, and a transition portion connects the inner portion to the outer portion, the frame layer being adhered to the backing layer on three of the four segments leaving a fourth segment un-adhered to the backing layer forming a access passage between the frame layer and the backing layer;

a generally rectangular mat layer for insertion through the access passage and positioning within the central opening of the frame layer, the mat having a aperture for viewing a photograph mounted on the backing layer, the peripheral edges of the mat layer being retained in the recess and locked in position by engagement with the embossed portion of the frame layer.

* * * * *